US008062037B1

(12) United States Patent
Chapa, Jr. et al.

(10) Patent No.: US 8,062,037 B1
(45) Date of Patent: Nov. 22, 2011

(54) ON-FIELD VISION TRAINING SYSTEM

(75) Inventors: Rodolfo Chapa, Jr., Portland, OR (US); Bruce Wojciechowski, Lake Oswego, OR (US); Justin Wojciechowski, Portland, OR (US); Michael Collier, Portland, OR (US)

(73) Assignee: Nike, Inc., Portland, OR (US)

( * ) Notice: Subject to any disclaimer, the term of this patent is extended or adjusted under 35 U.S.C. 154(b) by 511 days.

(21) Appl. No.: 12/178,587

(22) Filed: Jul. 23, 2008

Related U.S. Application Data

(63) Continuation-in-part of application No. 12/030,845, filed on Feb. 13, 2008.

(60) Provisional application No. 60/901,198, filed on Feb. 13, 2007.

(51) Int. Cl.
*A63B 69/00* (2006.01)

(52) U.S. Cl. ..... 434/251

(58) Field of Classification Search ..... 434/247, 434/248, 251, 252; 473/422, 438, 569; D21/712
See application file for complete search history.

(56) References Cited

U.S. PATENT DOCUMENTS

| | | | | |
|---|---|---|---|---|
| 3,353,824 | A * | 11/1967 | Hamson, Jr. | 473/458 |
| 3,370,851 | A * | 2/1968 | Murray | 473/438 |
| 5,330,176 | A * | 7/1994 | Cagney, Jr. | 473/452 |
| D375,129 | S * | 10/1996 | Daicos | D21/712 |
| 5,947,845 | A * | 9/1999 | Canelas | 473/446 |
| 6,722,889 | B1 * | 4/2004 | Page et al. | 434/251 |
| 6,852,039 | B2 * | 2/2005 | Pettigrew et al. | 473/280 |
| D505,462 | S * | 5/2005 | Horkan et al. | D21/712 |
| 7,059,862 | B2 * | 6/2006 | McGinley | 434/247 |
| 7,186,184 | B2 * | 3/2007 | Buck | 473/218 |
| 7,616,098 | B2 * | 11/2009 | Al-Sabah | 340/323 R |
| 2005/0119071 | A1 * | 6/2005 | Carbonero | 473/422 |
| 2005/0221919 | A1 * | 10/2005 | Eite | 473/446 |
| 2008/0206723 | A1 * | 8/2008 | Hunter | 434/156 |
| 2010/0062883 | A1 * | 3/2010 | Bevier et al. | 473/597 |

* cited by examiner

*Primary Examiner* — Kurt Fernstrom

(74) *Attorney, Agent, or Firm* — Banner & Witcoff, Ltd.

(57) ABSTRACT

An on-field vision training system is disclosed that provides a visual identifier near the athlete during game play and training exercises and other visual identifier positioned away from the athlete, but so as to still be seen by the athlete during game play and training exercises. The athlete uses the visual identifiers during game play and training exercises to improve vision, focus, and concentration. An American football having unique visual identifiers for use as an in-flight visual training tool is also disclosed.

20 Claims, 6 Drawing Sheets

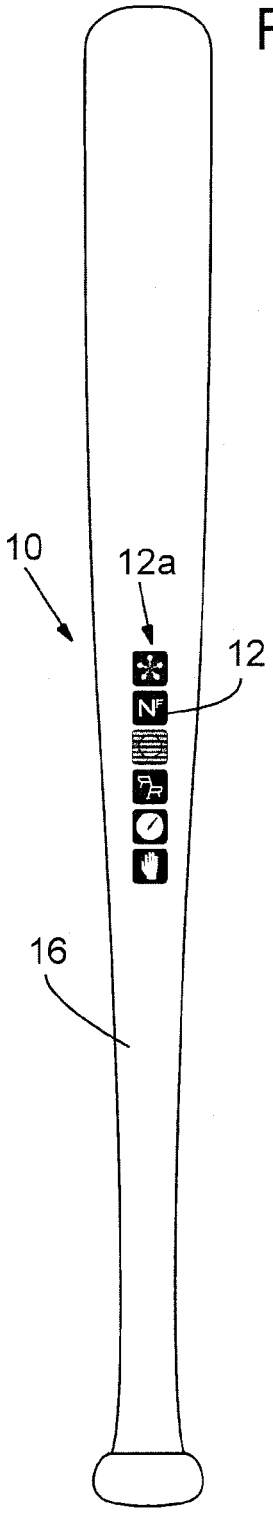
FIG. 1
FIG. 2
FIG. 3
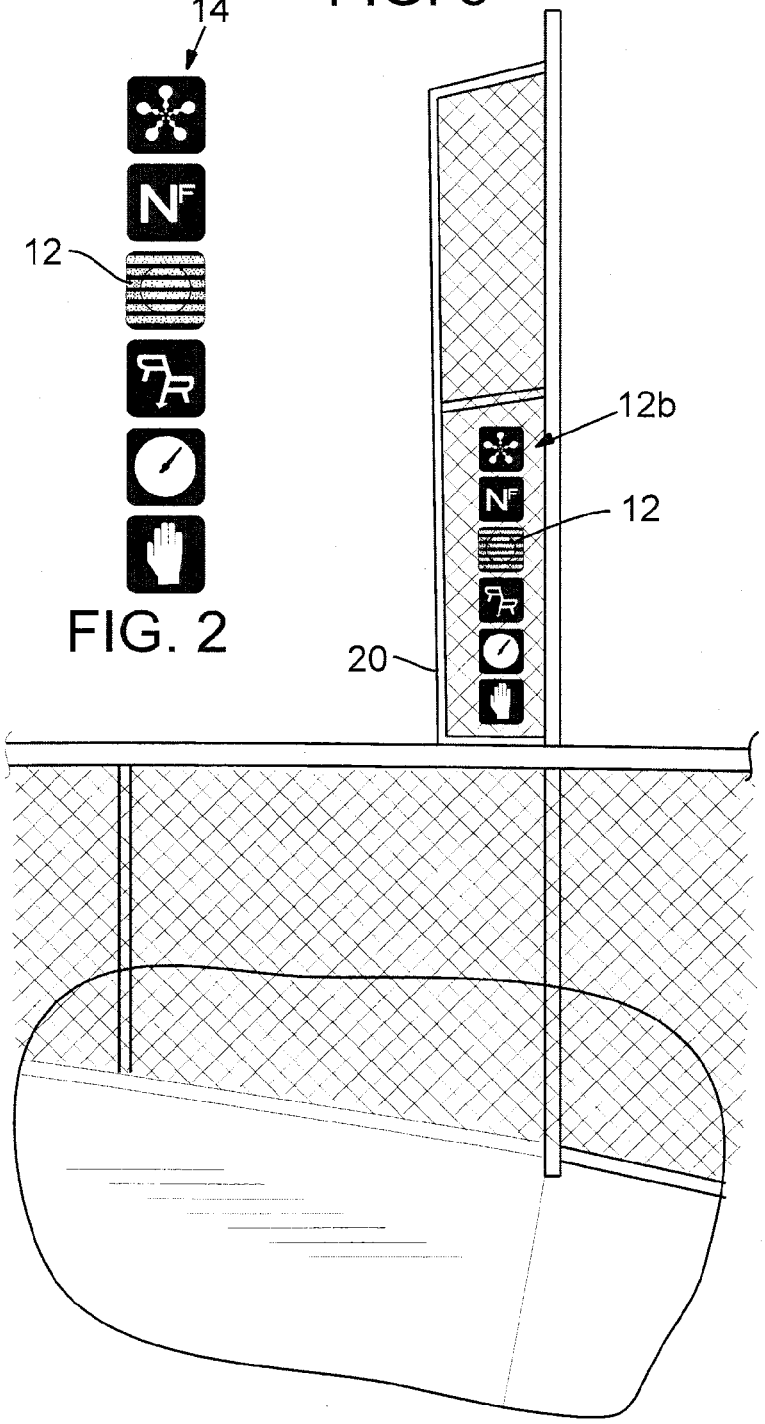

ON-FIELD VISION TRAINING SYSTEM

CROSS-REFERENCE TO RELATED APPLICATION

This application is a continuation-in-part of U.S. patent application Ser. No. 12/030,845, filed on Feb. 13, 2008, and it claims priority to U.S. provisional patent application Ser. No. 60/901,198, filed on Feb. 13, 2007.

FIELD OF THE INVENTION

The present invention relates to a vision training system for use primarily on-field by athletes.

BACKGROUND OF THE INVENTION

In order for most athletes to perform at peak efficiency, they must effectively view their surroundings and circumstances and they typically must quickly and precisely react accordingly. Athletes usually spend hours, days, and months training so as to increase their athletic performance, but they often neglect taking steps to improve their vision and reaction time accordingly.

Known vision improving exercises and methods are typically performed off-field, and usually not during game play. As a result, when athletes are involved in game play and the like, they tend to forget or not use their vision improving techniques, thereby rendering them useless at improving an athlete's performance when it counts most, during the sporting event.

Similarly, many vision training drills and exercises to not use traditional equipment used by an athlete while playing their particular sport.

SUMMARY OF THE INVENTION

Accordingly, despite the available athlete vision training systems and devices, there remains a need for an on-field vision training system that has been proven to improve sports visual performance during game play, and that readily reminds the athlete to following the vision training lessons during game play. In addition to the other benefits disclosed herein, the present invention fulfills these needs.

FIGURES

FIG. 1 is an exemplar on-field vision training system with a visual display configured for use on a baseball bat in accordance with an embodiment of the present invention.

FIG. 2 is an enlarged visual display of the on-field vision training system of FIG. 1.

FIG. 3 is an exemplar on-field mounted visual display of the on-field vision training system of FIG. 1.

DETAILED DESCRIPTION OF PREFERRED EMBODIMENTS

Figure 4:
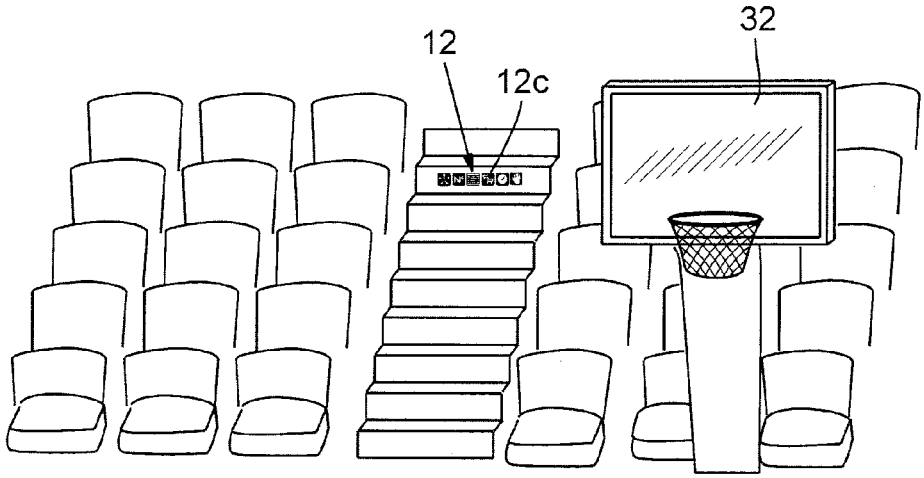
FIG. 4 is the exemplar on-field vision training system of FIG. 1 configured for use in basketball in accordance with an embodiment of the present invention.

An on-field vision training system 10 is disclosed in FIGS. 1-11 and discussed herein.

In general, the training system 10 has a visual display 12 that is preferably a sequence of images aligned in a row 14 (FIG. 2). Each image of the sequence of images preferably represents a symbol that the athlete has pre-associated as a reminder to perform a particular task or event during game play. A first visual display 12*a* is preferably positioned somewhere near or on the athlete, and at least a second visual display 12*b* with preferably the same sequence of images is posited at one or more locations throughout the sports field so that the second visual display 12*b* is visible by the athlete during game play. During game play, the athlete uses the visual displays 12*a*, 12*b* primarily as a vision training and concentration tool.

The on-field vision training system 10 is allows athletes to complete a series of sport-specific vision exercises to improve visual skills on the field and thereby improve the athlete's performance on the field of play. The system is designed to work the athlete's visual, neural and cognitive systems through a specific sequence of exercises which have been proven to improve sports visual performance. The order and sequence of exercises is preferably very specific and organized specifically to enhance the performance of the eyes for a particular sport activity.

Referring to FIGS. 1-8, the visual display 12 of the on-field vision training system 10 preferably has five symbols which are affixed, preferably by being detachably secured with adhesive tape or the like, or incorporated into the actual design of various articles of on-field equipment, including bats 16 (FIG. 1), sports gloves 18 (FIG. 7) and articles of footwear 20 (FIG. 5) are used in combination with similar symbols which are affixed at various points on the field of play as shown in FIGS. 1-8. The player then uses this system of symbols to perform various exercises which condition the eyes, neurons and cognitive system to work together in an optimal manner to maximize the athlete's visual performance on the field of play. The system 10 allows training and conditioning of an athlete's visual skills in the context of the field of play, with all of the attendant variables, distractions and other factors that affect performance in actual sporting contests. Exemplar visual symbols and sequences are shown in FIG. 2.

Referring to FIGS. 1-3, an exemplar on-field vision training system configured for use during a baseball game is shown. The visual display 12*a* is affixed to a baseball bat 16 while a larger visual display 12*b* having the same sequence of characters is affixed along the outfield fence 20 or the like. During game play the athlete uses both visual displays 12*a*, 12*b* to focus on the batting event and improve visual cue sensing. For example, when stepping up to the plate for his or her turn a bat, the athlete may initially focus on the third character down on the visual display 12*a*, and then look to the outfield to find that same character on the outfield visual display 12*b*. He or she may then initiate other pre-determined sequences of viewing these and other symbols, thereby forcing the athlete to focus on these events and become less distracted by other events, such as cheering or hostile spectators, arising during game play.

Figure 5:
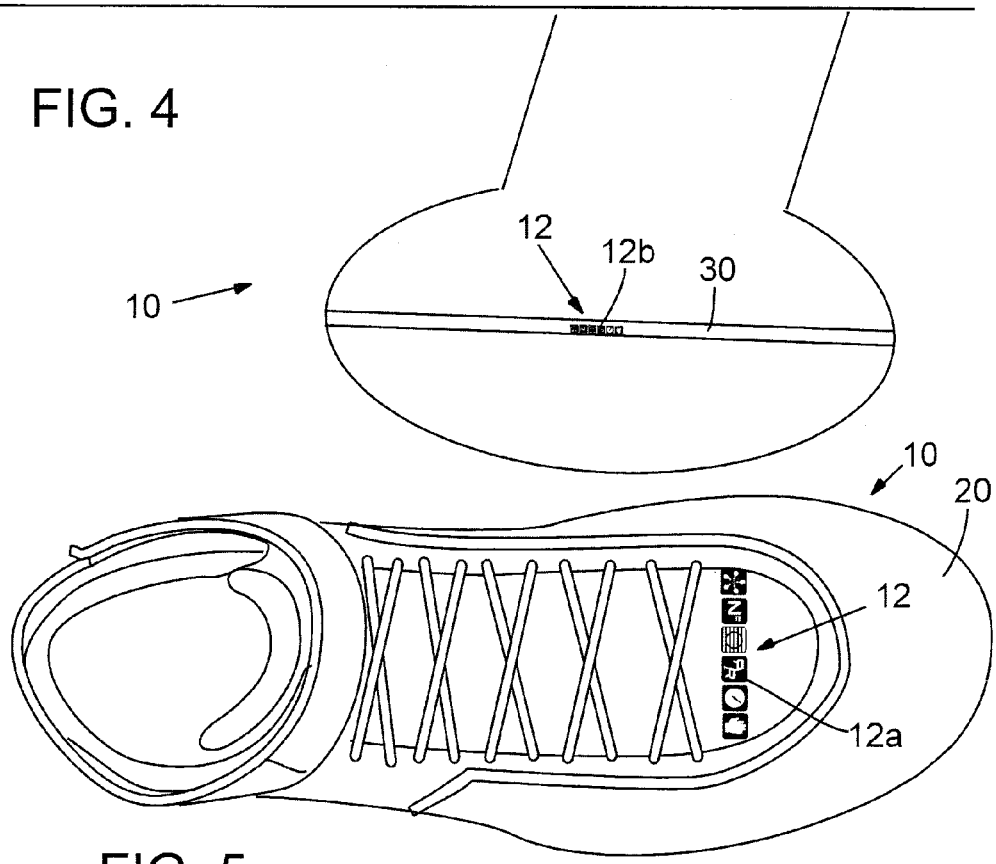
FIG. 5 is an exemplar on-field vision training system with a visual display configured for use on an article of footwear in accordance with an embodiment of the present invention.
Figure 6:
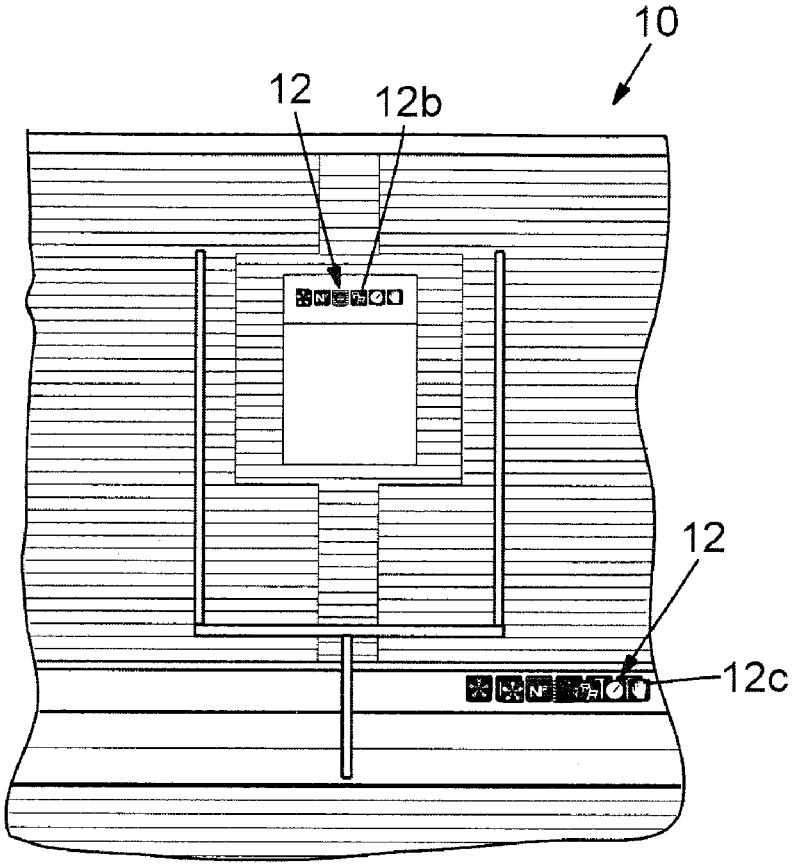
FIG. 6 is the exemplar on-field vision training system of FIG. 1 configured for use in American football in accordance with an embodiment of the present invention.
Figure 7:
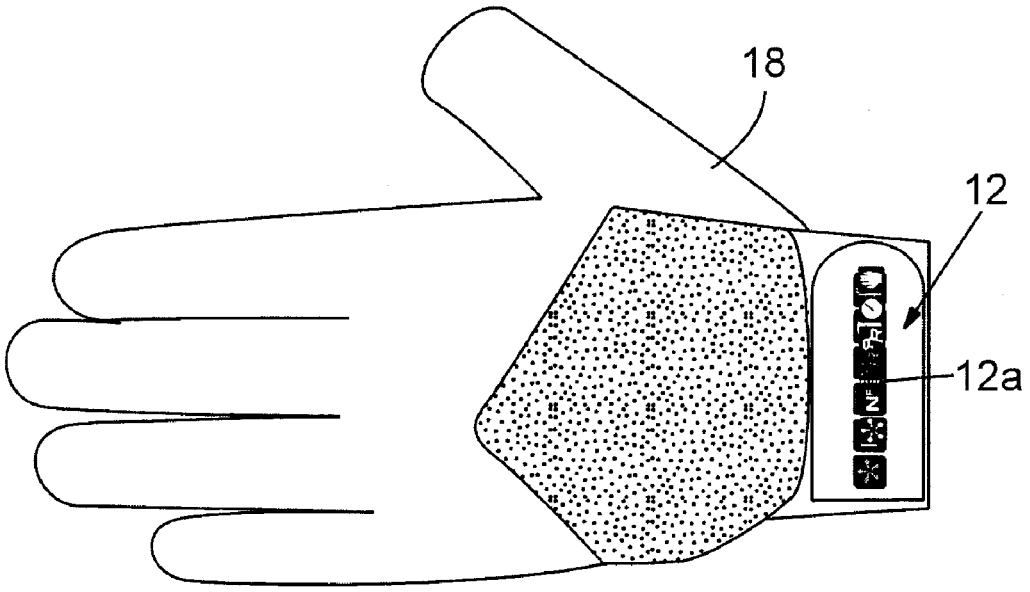
FIG. 7 is an exemplar on-field vision training system with a visual display configured for use on a glove in accordance with an embodiment of the present invention.
Figure 8:
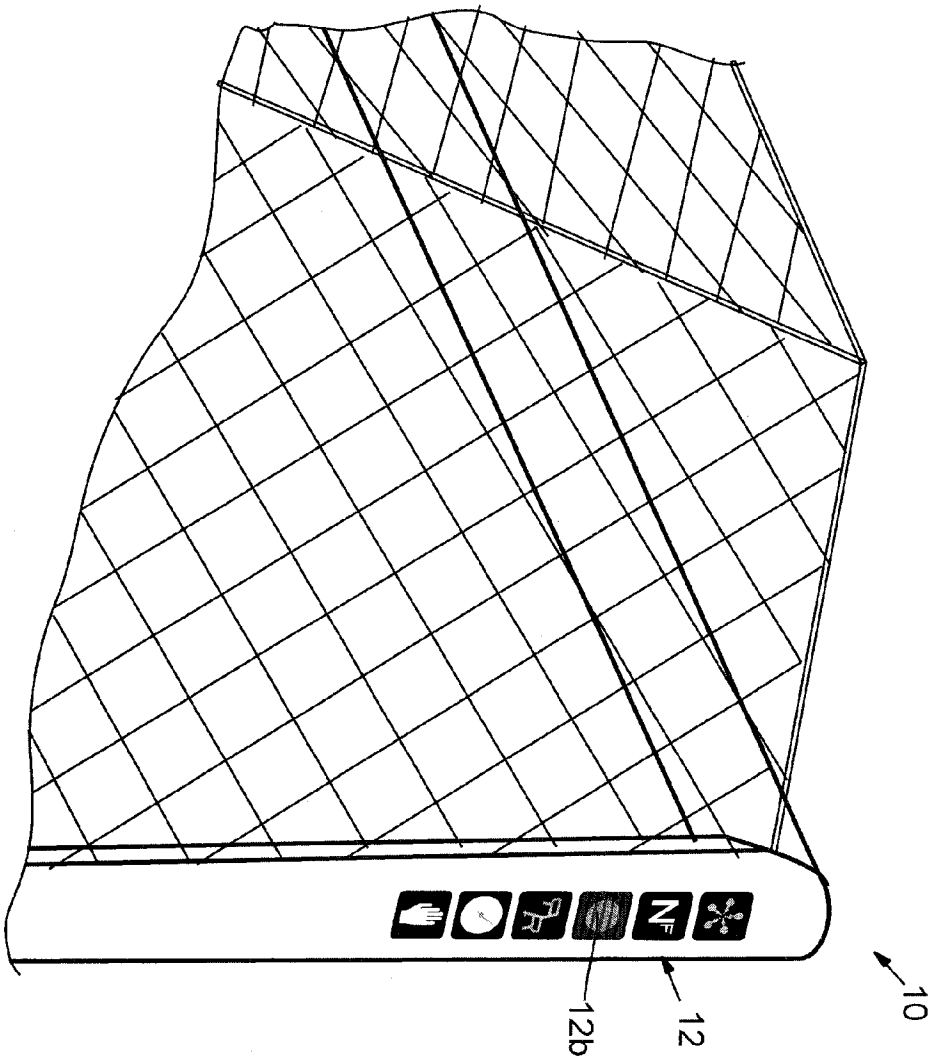
FIG. 8 is the exemplar on-field vision training system of FIG. 1 configured for use in soccer in accordance with an embodiment of the present invention.

Referring to FIGS. 4 & 5, an exemplar on-field vision training system configured for use in basketball is shown. The visual display 12 is affixed to an article of footwear 20 worn by the athlete, and another visual display 12*c* is affixed to or near the backboard 32 of the basket. During a free throw, an athlete uses both visual displays 12*a*, 12*c* to focus on the free throw event, follow and remember established free-throw procedures, and reduce undue distractions from interfering with making the shot. For example, when stepping up to free throw line 30, the athlete may initially focus one or more of the characters of the shoe mounted visual display 12*a*, and then look for the same characters on the near backboard mounted visual display 12*c*. He or she may then initiate other pre-determined sequences of viewing these and other symbols, thereby forcing the athlete to focus in preparation for taking the free throw. A third visual display 12*b* may also be provided and used, such as at the free throw line 30 or the like. Referring to FIG. 6, an exemplar on-field vision training system configured for use in American football is shown. The visual display 12*a* is preferably affixed to a glove 18 (FIG. 7) worn by the athlete, the football 50 (FIGS. 9A & 9B) used during game play or practice, and one or more other visual displays 12*b*, 12*c* are preferably positioned around the football field as shown. A similar arrangement is also shown in a soccer configuration in FIG. 8.

Figure 9A:
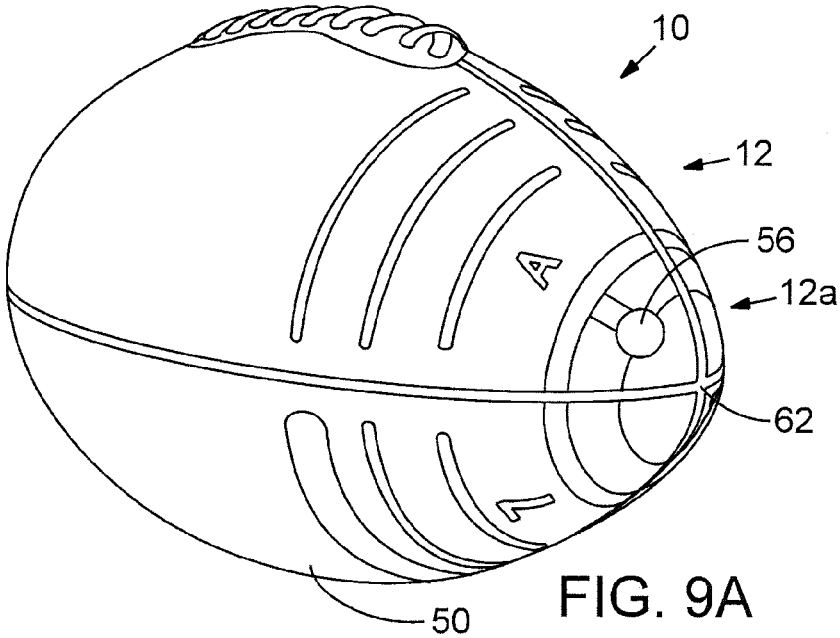
FIG. 9A is a front, isometric view of an exemplar on-field vision training system configured for use on an American football in accordance with an embodiment of the present invention.

Referring to FIGS. 9A-11, a preferred visual display pattern for use on a football 50 is shown. Preferably, the pattern includes a series of concentric, different colored circles/rings 66, 68, 70 extending from the respective ends 62, 64 of the football 50 as best shown in FIG. 9A. The center circle 62 is preferably different colors on each end 62, 64 of the football, with a first concentric ring 68 extending there-around in a different color from the color of the adjacent center circle 62. A second concentric ring 70 is preferably aligned around the first concentric ring 68, and it is preferably a different color from the adjacent center ring 62 and first concentric ring 68. Preferably, the second concentric ring is yellow.

A preferred exemplar color pattern is to have a red center circle 66, blue first concentric ring 68, and yellow second concentric ring 70 on one side 62 (FIG. 11) of the football 50, and a blue center circle 66, red first concentric ring 68, and yellow second concentric ring 60 (FIG. 10) on the opposite side 66 of the football 50. Accordingly, one drill using these color patterns is for the thrower of the football 50 to position one of the two sides 62, 66 toward the athlete, and throw the football 50 toward the athlete. The athlete then calls out the color (red or blue) of the center circle 66 directed toward them while the football 50 is in-flight.

Figure 10:
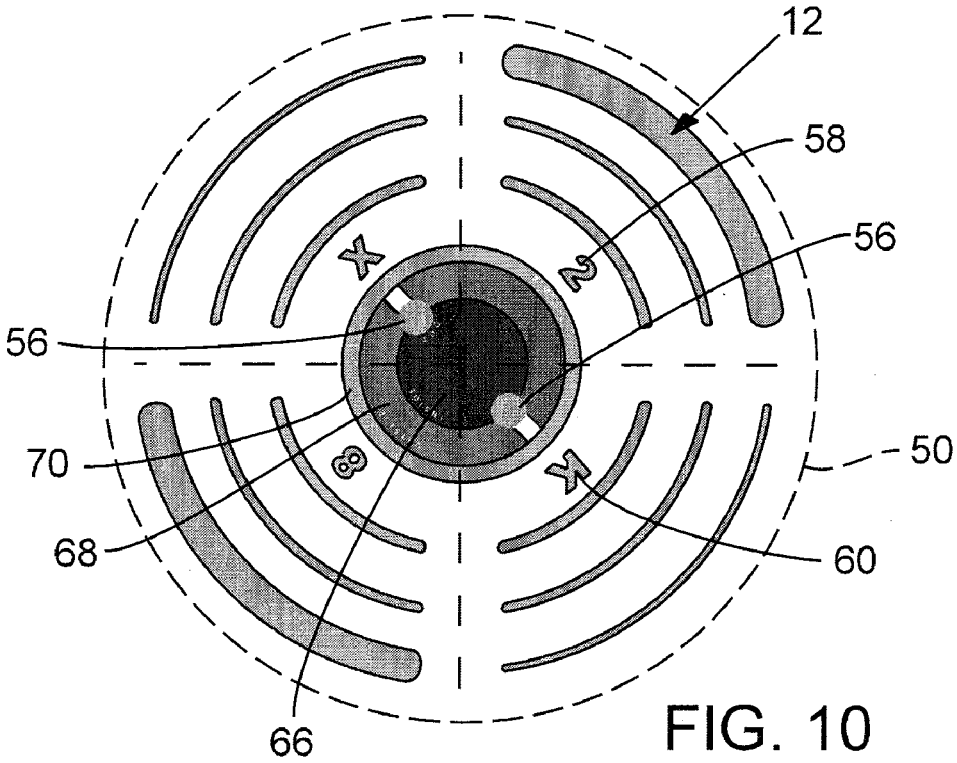
FIG. 10 is an exemplar visual display pattern for use on a first end of the football of FIG. 9A.
Figure 11:
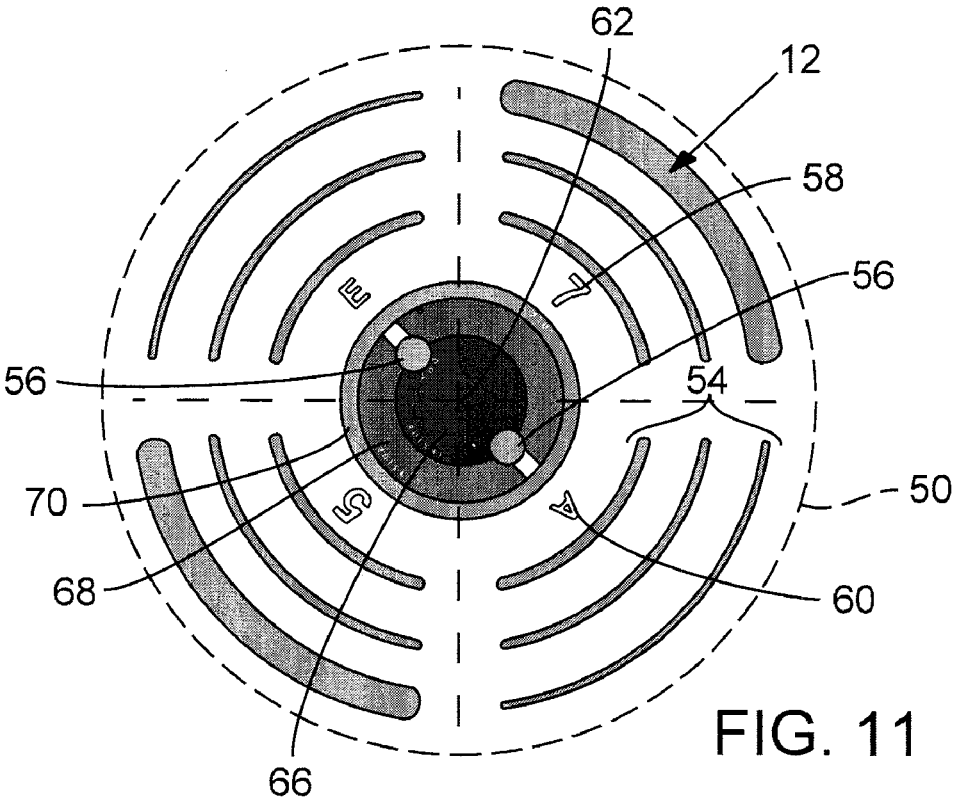
FIG. 11 is an exemplar visual display pattern for use on a second end of the football of FIG. 9A.

The size of the center circle 62 and rings 68 and 70 can also be optimized for maximum visual training. For example, one end 62 (FIG. 11) of the football 50 may have a smaller sized center circle 62 and rings 68 and 70, than those items found on the opposite side 66 (FIG. 10). Accordingly, as an athlete's vision training improves using the side having the larger visual pattern, he or she may select the more difficult visual pattern found on the opposite side to further improve his or her vision training.

In addition, a pair of small brightly colored circles 56 (which are preferably yellow) are preferably positioned on the visual display. These small brightly colored circles 56 are preferably positioned opposite each other so as to straddle the ends 62, 66 as shown.

Figure 9B:
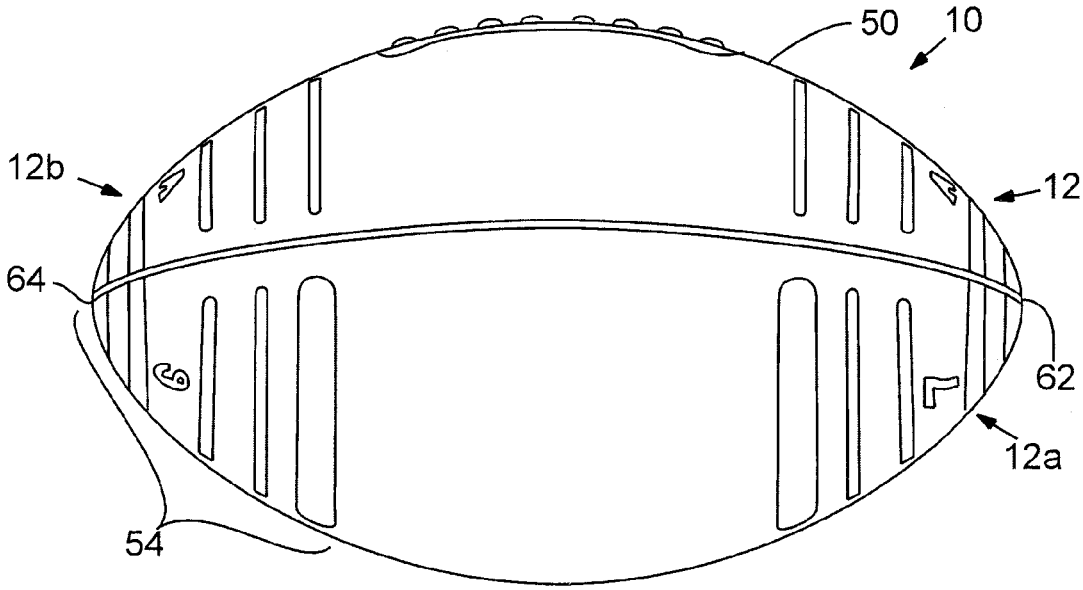
FIG. 9B is a side view of the football of FIG. 9A.

More preferably, a plurality of elongate, concentrically aligned, spaced apart lines 54 are provided along the "catch zone" of the football as best shown in FIGS. 9A & 9B. These lines offer a visual indicator to the athlete as to where he or she should seek to catch the ball.

In addition, one or more numbers 58 and/or letter 60 are provided on the football. These numbers 58 and letters 60 allow for vision training exercises such as number/letter call-out drills to be performed with an in-flight football.

With a football marked as described, it can be appreciated that an athlete uses the visual cues to assist with focus and concentration. The visual displays are preferably incorporated into a wide variety of in-flight ball, route, passing and hand-eye coordination drills.

Having described and illustrated the principles of our invention with reference to a preferred embodiment thereof, it will be apparent that the invention can be modified in arrangement and detail without departing from such principles. For example, the sporting events shown and the symbols displayed are exemplarily only. In view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

We claim:

1. A football comprising:

a prolate spheroid having an axis of symmetry extending from a first end to a second end;

an equatorial diameter on an equatorial plane perpendicular to the axis of symmetry located about a center point of the axis of symmetry;

a first visual display positioned about the first end of the prolate spheroid;

a second visual display positioned about said second end;

the first visual display and the second visual display each comprising a pattern of concentric circles originating from a first circle centered about the respective end and at least one circle of said pattern of concentric circles for each display has a different color than a second circle of the same display; and wherein the first concentric circle of the first visual display has a first diameter that is larger than a second diameter of the first concentric circle of the second visual display.

2. The football of claim 1, wherein the diameter of the first concentric circle of the first end is larger than a diameter of a second concentric circle of the second end.

3. The football of claim 1, wherein the first concentric circle of the first visual display is a first color and the first concentric circle of the second visual display is a second color.

4. The football of claim 1, wherein the diameter of the collective concentric circles of the first visual display is larger than the diameter of the collective concentric circles of the second visual display.

5. The football of claim 1, wherein the first visual display consists of two concentric circles and the second visual display consists of three concentric circles.

6. The football of claim 1, wherein the first visual display extends less than 10% of the distance from the first end to the second end when measured along the axis of symmetry.

7. The football of claim 1, wherein the first visual display extends less than 5% of the distance from the first end to the second end when measured along the axis of symmetry.

8. The football of claim 6, further comprising:

a first plurality of elongate, concentrically-aligned, spaced apart lines located on the prolate spheroid between the first visual display and the equatorial diameter.

9. The football of claim 8, further comprising:

a second plurality of elongate, concentrically-aligned, spaced apart lines located on the prolate spheroid between the second visual display and the equatorial diameter, wherein at least one of the second plurality of lines is a different color than at least one of the first plurality of lines.

10. The football of claim 8, further comprising:

a second plurality elongate, concentrically-aligned, spaced apart lines located on the prolate spheroid between the second visual display and the equatorial diameter, wherein at least one of the second plurality of lines is thicker than at least one of the first plurality of lines.

11. A method of performing a vision training exercise comprising:

selecting by a first user whether to direct a first end or a second end of a prolate spheroid towards a second user during a flight of the prolate spheroid, wherein the prolate spheroid comprises:

an axis of symmetry extending from the first end to a second end and an equatorial diameter on an equatorial plane perpendicular to the axis of symmetry located about a center point of the axis of symmetry;

a first visual display positioned about the first end of the prolate spheroid;

a second visual display positioned about said second end;

the first visual display and the second visual display each comprising a pattern of concentric circles originating from a first circle centered about the respective end; and at least one circle of said pattern of concentric circles for each display has a different color than a second circle of the same display; and wherein the first concentric circle of the first visual display has a first diameter that is larger than a second diameter of the first concentric circle of the second visual display; and propelling the prolate spheroid into the flight causing it to spin on the axis of symmetry such that the selected end is consistently directed in a direction towards the second user and the other end is consistently directed in a direction away from the second user to permit the second user to visually discern a property of the visual display located on the selected side during the flight.

12. The method of claim 11, further comprising:

requesting feedback from the second user during the flight of the prolate spheroid relating to the property of the visual display selected to be directed towards the second user.

13. The method of claim 11, further comprising:

receiving feedback from the second user during the flight of the prolate spheroid relating to a property of the visual display selected to be directed towards the second user by the first user, such that the feedback requires a second user to locate and discern the property of the selected visual display during flight.

14. The method of claim 13, wherein the received feedback from the second user during the flight of the prolate spheroid comprises audio feedback relating to the color of at least one concentric circle of the visual display selected to be directed towards the second user by the first user.

15. The method of claim 13, wherein the received feedback from the second user during the flight of the prolate spheroid comprises audio feedback relating to the position of at least one concentric circle of the visual display selected to be directed towards the second user by the first user relative to another concentric circle of the same visual display.

16. The method of claim 13, wherein the flight is a first flight and the method further comprising:

based upon the second user's feedback during the first flight, selecting by the first user whether to direct the first end or the second end of the prolate spheroid towards the second user during a second flight of the prolate spheroid.

17. The method of claim 11, wherein the diameter of the first concentric circle of the first end of the prolate spheroid is larger than a diameter of a second concentric circle of the second end.

18. The method of claim 11, wherein the first concentric circle of the first visual display of the prolate spheroid is a first color and the first concentric circle of the second visual display is a second color.

19. The method of claim 11, wherein the first visual display extends less than 10% of the distance from the first end to the second end when measured along the axis of symmetry.

20. The method of claim 11, wherein the prolate spheroid used by the first user further comprises:

a first plurality of elongate, concentrically-aligned, spaced apart lines located on the prolate spheroid between the first visual display and the equatorial diameter; and a second plurality of elongate, concentrically-aligned, spaced apart lines located on the prolate spheroid between the second visual display and the equatorial diameter, wherein at least one of the second plurality of lines is a different color or thickness than at least one of the first plurality of lines.

* * * * *